US011482811B2

(12) United States Patent
Nakamura et al.

(10) Patent No.: US 11,482,811 B2
(45) Date of Patent: Oct. 25, 2022

(54) LEVER-TYPE CONNECTOR

(71) Applicants: YAZAKI CORPORATION, Tokyo (JP); NISSAN MOTOR CO., LTD., Yokohama (JP)

(72) Inventors: Masatoshi Nakamura, Shizuoka (JP); Kazuto Ohtaka, Shizuoka (JP); Takahiro Yoneda, Kanagawa (JP); Aritsugu Hirose, Kanagawa (JP)

(73) Assignees: YAZAKI CORPORATION, Tokyo (JP); NISSAN MOTOR CO., LTD., Yokohama (JP)

( * ) Notice: Subject to any disclaimer, the term of this patent is extended or adjusted under 35 U.S.C. 154(b) by 0 days.

(21) Appl. No.: 17/154,073

(22) Filed: Jan. 21, 2021

(65) Prior Publication Data

US 2021/0143580 A1 May 13, 2021

Related U.S. Application Data

(63) Continuation of application No. PCT/JP2019/031747, filed on Aug. 9, 2019.

(30) Foreign Application Priority Data

Aug. 17, 2018 (JP) ..... JP2018-153387

(51) Int. Cl.
*H01R 13/629* (2006.01)
*H01R 13/631* (2006.01)
*H01R 13/74* (2006.01)

(52) U.S. Cl.
CPC ..... *H01R 13/62938* (2013.01); *H01R 13/631* (2013.01); *H01R 13/74* (2013.01)

(58) Field of Classification Search
CPC ..... H01R 13/62938; H01R 13/62933; H01R 13/62955; H01R 13/631; H01R 13/74
See application file for complete search history.

(56) References Cited

U.S. PATENT DOCUMENTS 6,183,275 B1 * 2/2001 Okura ..... H01R 13/62933 439/157
6,685,496 B2 * 2/2004 Ookura ..... H01R 13/5202 439/372

(Continued)

FOREIGN PATENT DOCUMENTS

JP 2002-359035 A 12/2002
JP 2002-359037 A 12/2002

(Continued)

*Primary Examiner* — Renee S Luebke
*Assistant Examiner* — Milagros JeanCharles
(74) *Attorney, Agent, or Firm* — Sughrue Mion, PLLC

(57) ABSTRACT

A lever-type connector includes: a first housing; a second housing capable of fitted to and removed from the first housing; a lever rotatably supported by the second housing for fitted to and removed the first housing and the second housing by a rotation operation; a support shaft provided on the second housing; a bearing portion provided on the lever and comprising a shaft sliding groove for sliding the support shaft; a cam follower provided on the lever; a cam groove provided on the first housing, the cam groove to which the cam follower is engageable; a guide protrusion provided on the second housing, and a guide groove provided on the lever, the guide groove to which the guide protrusion is engageable. When the first housing and the second housing are completely fitted by the rotation operation of the lever, the lever becomes slidable with respect to the second housing.

3 Claims, 9 Drawing Sheets

(56) References Cited

U.S. PATENT DOCUMENTS

| | | | | |
|---|---|---|---|---|
| 2002/0173185 | A1* | 11/2002 | Fukushima ..... | H01R 13/6295<br>439/157 |
| 2002/0182928 | A1 | 12/2002 | Matsushita | |
| 2017/0346227 | A1 | 11/2017 | Chikusa et al. | |

FOREIGN PATENT DOCUMENTS

| | | | |
|---|---|---|---|
| JP | 2003-100382 | A | 4/2003 |
| JP | 2013-134810 | A | 7/2013 |
| JP | 2017-216067 | A | 12/2017 |

* cited by examiner

LEVER-TYPE CONNECTOR

CROSS-REFERENCE TO RELATED APPLICATIONS

The present application is a continuation of International Application No. PCT/JP2019/031747, filed on Aug. 9, 2019, and based upon and claims the benefit of priority from Japanese Patent Application No. 2018-153387, filed on Aug. 17, 2018, the entire contents of which are incorporated herein by reference.

TECHNICAL FIELD

The disclosure relates to a lever-type connector.

BACKGROUND

As this type of lever-type connector, there is one disclosed in PTL 1 (JP 2002-359035 A).

Such a conventional lever-type connector disclosed in PTL 1 includes: a male housing having a shaft portion and an arc-like pushing portion on each side surface; a female housing that can be fitted to and removed from the male housing and is provided with a cam follower on each side surface; and a lever having a bearing hole fitted to the shaft par, a cam groove in which the cam follower is engaged, and an anti-cantilever type movement detection portion that rides on the pushing portion when the lever is in a semi-fitting state, each provided on each of a pair of arms extending from each end of an operation part.

Then, when the lever is rotated by a pressing operation of the operation part, the cam groove of the lever moves along the cam follower, and the male housing and the female housing are fitted each other. Also, if the male housing and the female housing are incompletely fitted and are not yet fitted, and if you try to fit the lever-type connector into a mounting hole of a vehicle body panel, the movement detection portion rides on the pushing portion thus the movement detection portion elastically deforms to the outside of the outer surface of the arm and protrudes. In this state, the movement detection portion interferes with the mounting hole, the lever-type connector cannot be fitted into the mounting hole, and is detected that the male housing and female housing are in a semi-fitted state.

SUMMARY

However, in the conventional lever-type connector, due to factors such as variations in product size, rattling of parts assembly, and connector tilt during vehicle body assembly, the amount of interference between the lever arm and the vehicle body panel is insufficient, the half fitted connector may be attached to the body panel.

The present application has been made to solve the above-mentioned problems, and provides a lever-type connector capable of easily and reliably assembling only a male housing and a female housing, which are completely fitted to each other, to a vehicle body panel.

A lever-type connector according to an embodiment includes: a first housing; a second housing capable of being fitted to and removed from the first housing; a lever rotatably supported by the second housing, the lever for being fitted to and removed the first housing and the second housing by a rotation operation; a support shaft provided on one of the second housing and the lever; a bearing portion provided on the other of the second housing and the lever, the bearing portion comprising a shaft sliding groove for sliding the support shaft; a cam follower provided on one of the lever and the first housing; a cam groove provided on the other of the lever and the first housing, the cam groove to which the cam follower is engageable; a guide protrusion provided on one of the lever and the second housing, and a guide groove having an arc-shape provided on the other of the lever and the second housing, the guide groove to which the guide protrusion is engageable. When the lever is in the rotation operation, the guide protrusion engaged with the guide groove is guided by the arc-shape of the guide groove, and when the first housing and the second housing are completely fitted by the rotation operation of the lever, the engagement between the guide protrusion and the guide groove is released and the lever becomes slidable with respect to the second housing.

According to the lever-type connector of the embodiment, the engagement between the guide protrusion and the guide groove is released when the fitting of the first housing and the second housing is completed by the rotation operation of the lever, thereby the lever is slidable with respect to the second housing. Therefore, the lever-type connector can be easily and surely assembled to the vehicle body panel only when the fitting of the first housing and the second housing is completed.

DETAILED DESCRIPTION

Embodiments will be described below with reference to the drawings.

Figure 1:
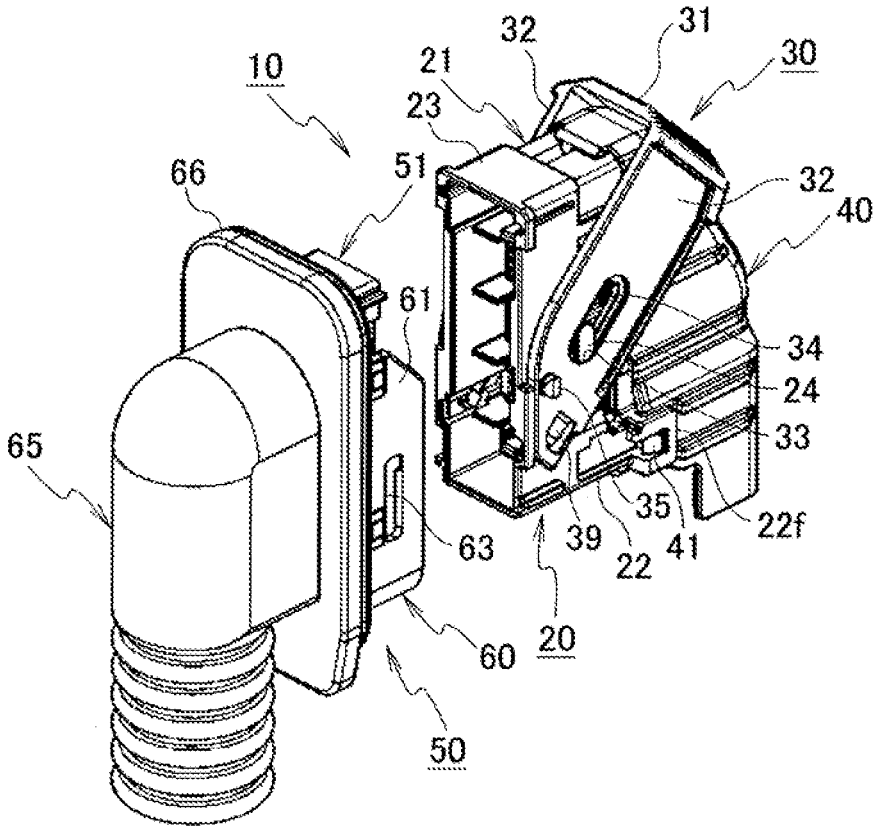
FIG. 1 is a perspective view illustrating a state before fitting of a lever-type connector according to an embodiment.
Figure 13:
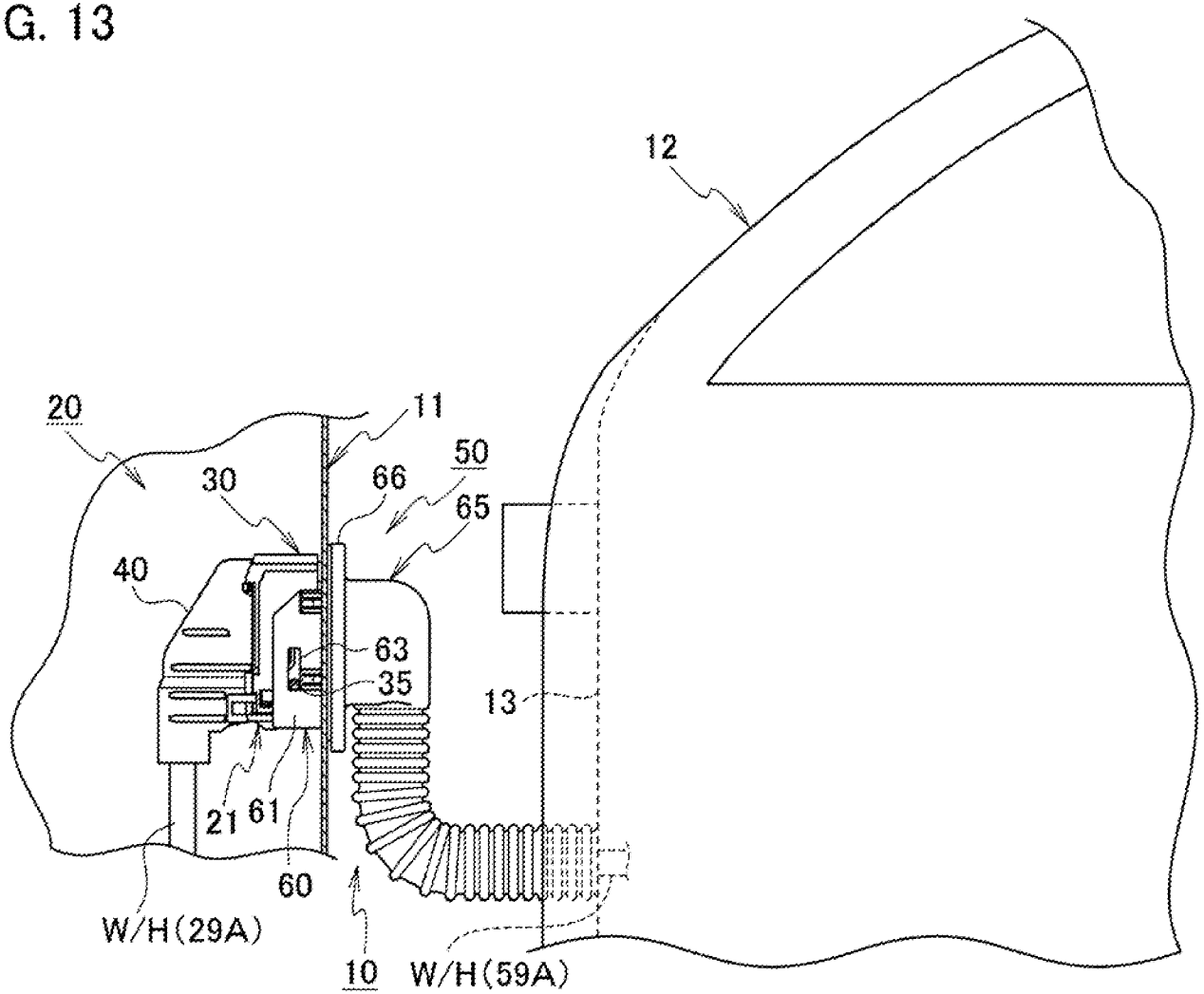
FIG. 13 is a side view illustrating, in a partial cross section, a state in which the lever-type connector according to the embodiment is attached to the vehicle body panel.

As illustrated in FIGS. 1 and 13, a lever-type connector 10 according to an embodiment includes a male connector 20 installed on a vehicle body panel 11 and a female connector 50 installed on the door 12.

Figure 2:
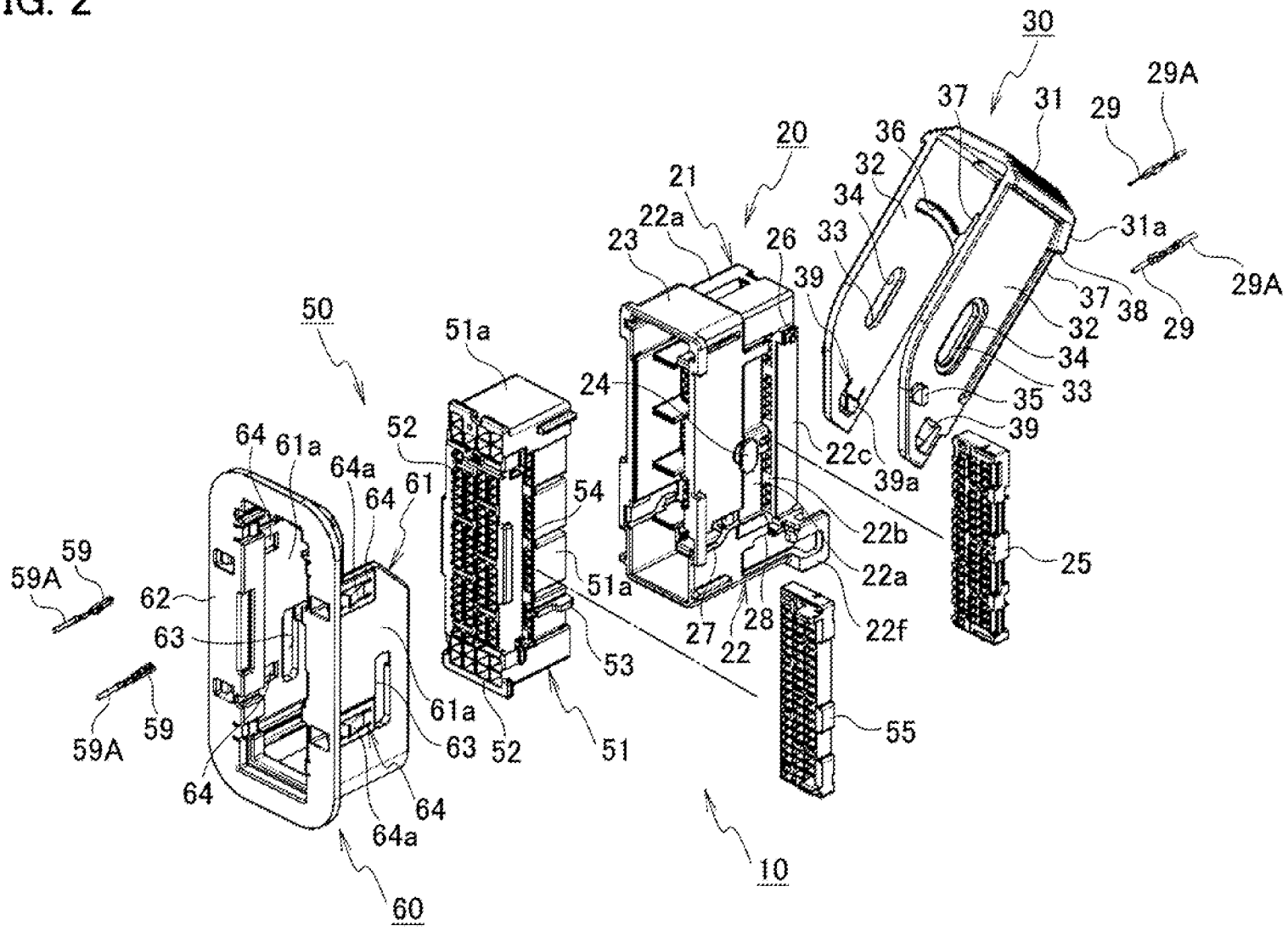
FIG. 2 is an exploded perspective view of the lever-type connector according to the embodiment.

As illustrated in FIG. 2, the male connector 20 includes: a synthetic resin male housing (second housing) 21 that accommodates a plurality of male terminals 29 and that can be fitted to and removed from a female housing (first housing) 51 of the female connector 50; a synthetic resin lever 30 that is rotatably and slidably supported to the male housing 21 by support shafts 24, the lever 30 for engaging and disengaging the male housing 21 and the female housing 51 by a rotating operation; and a synthetic resin wire cover 40 that is mounted so as to cover a rear surface 22*c* of the male housing 21.

The female connector 50 includes: the synthetic resin female housing (first housing) 51 that accommodates a plurality of female terminals 59 and that can be fitted to and removed from the male housing 21 of the male connector 20; a synthetic resin frame 60 having a rectangular frame and tubular shape that is fitted to the outer periphery of the female housing 51 and that is locked in a mounting hole 11*a* of the vehicle body panel 11; and a rubber grommet 65 attached to a flange portion 62 of the frame 60.

Figure 3:
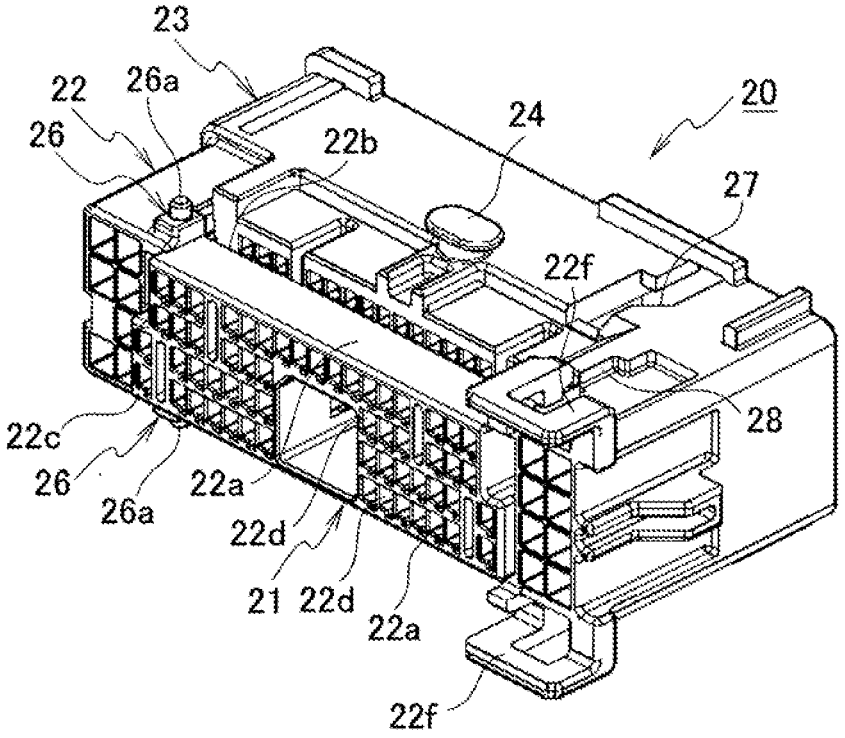
FIG. 3 is a perspective view of a male housing of the lever-type connector according to the embodiment.

As illustrated in FIGS. 2 and 3, the male housing 21 includes: a rectangular block-shaped housing main body 22 having terminal receiving holes 22*d* for receiving the male terminals 29; and a hood portion 23 integrally and projectingly formed on the front side of the housing main body 22, the hood portion 23 into which the female housing 51 is fitted. Each of support shafts 24 extending in a direction perpendicular to the fitting direction is integrally and projectingly formed at a boundary between each of side surfaces 22*a* of the housing body 22 and a entral hood portion 23.

Figure 12A:
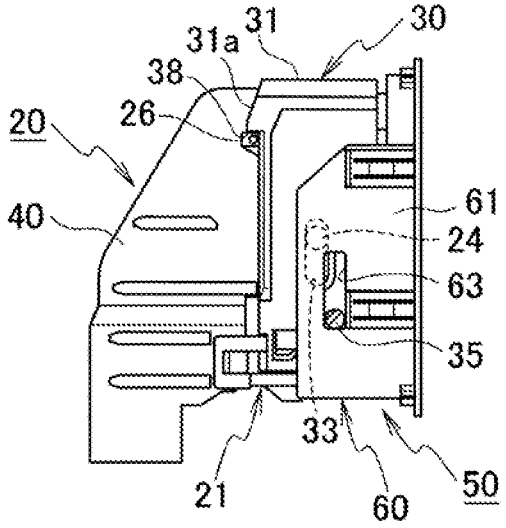
FIGS. 12A to 12C are side views illustrating a procedure for separating the male housing and the female housing of the lever connector according to the embodiment.

An opening 22*b* is formed on one side surface 22*a* of the housing body 22. A first side retainer 25 for locking the male terminal 29 is fitted into the opening 22*b*. Each of guide protrusions 26 is integrally formed on a rear surface 22*c* side of each of the side surfaces 22*a* of the housing body 22 at a position near an operation portion 31 of the lever 30. Each of the guide protrusions 26 is provided closer to the operation portion 31 side of the lever 30 than the support shaft 24 side when the lever 30 is rotated, as illustrated in FIG. 12C. An apex 26*a* of each of the guide protrusions 26 is set to be inside the sliding portion 37 and the abutting portion 38 of the lever 30 in the vertical direction.

Temporary locking recesses 27 and main locking recesses 28 are formed at positions corresponding to rotation loci of protrusions 39*a* of the locking arm 39 of the lever 30 on each of the side surfaces 22*a* of the hood portion 23 and the housing body 22. Each of locking portions 22*f* having a frame shape is integrally formed at a position near the main locking recess 28 on each side surface 22*a* of the housing body 22. The locking portions 22*f* locks locking protrusions 41 of the wire cover 40 that is mounted so as to cover the rear surface 22*c* side of the housing body 22.

Figure 4:
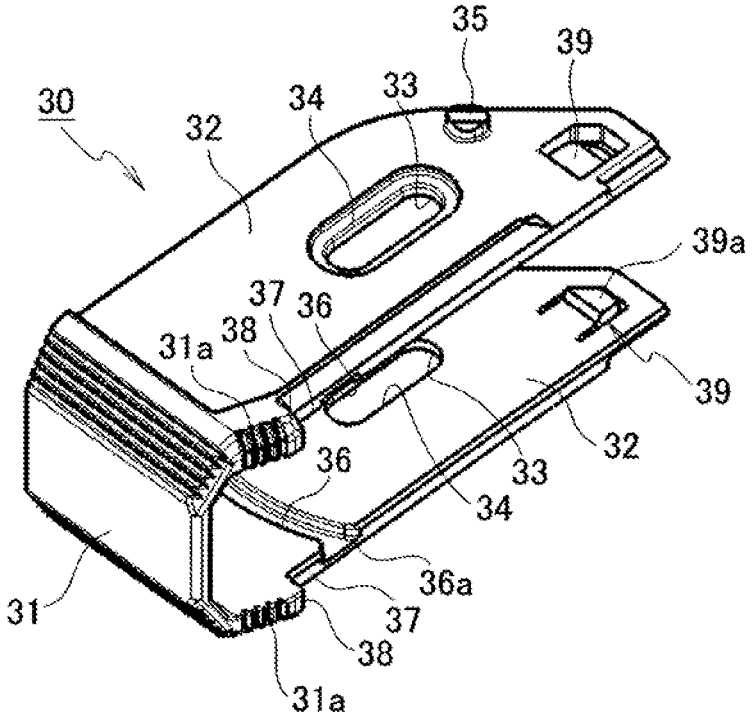
FIG. 4 is a perspective view of a lever of the lever-type connector according to the embodiment.

As illustrated in FIGS. 1, 2, and 4, the lever 30 includes the operation portion 31 and a pair of arm portions 32 extending from respective side portions of the operation portion 31.

Figure 10:
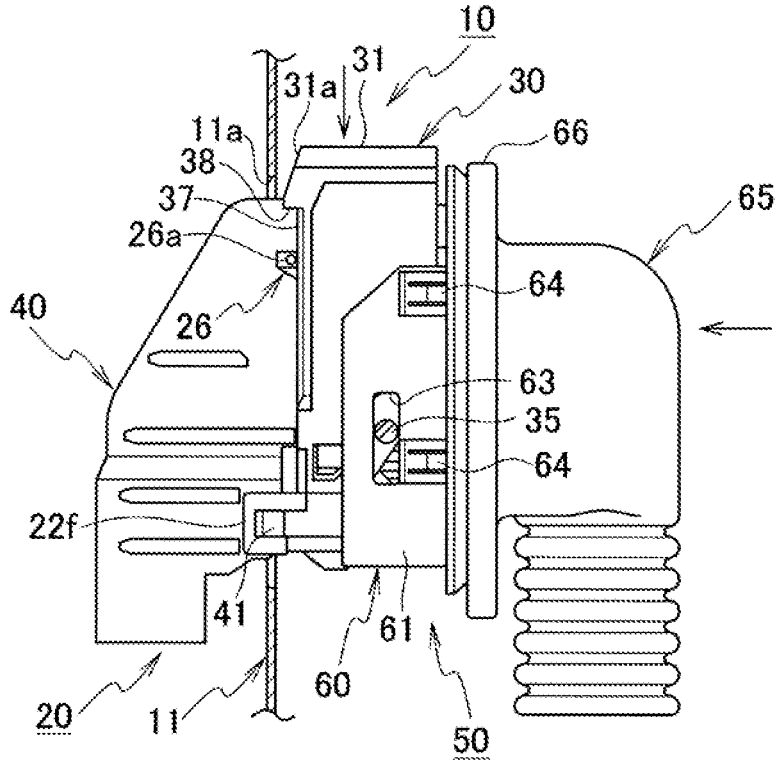
FIG. 10 is a side view illustrating a positional relationship between a mounting hole of the vehicle body panel and the lever before the lever of the lever-type connector according to the embodiment slides.
Figure 11:
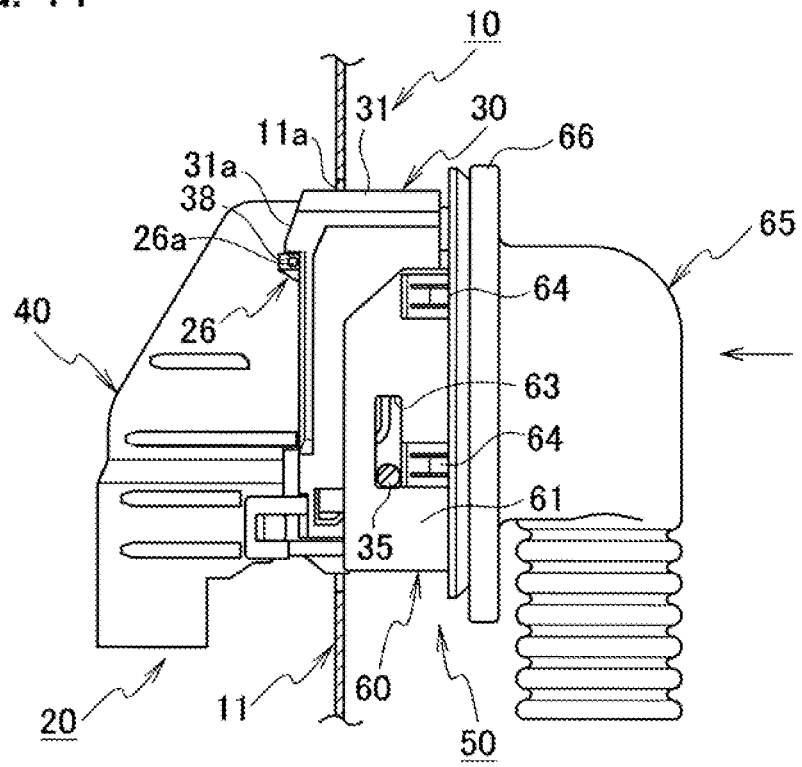
FIG. 11 is a side view illustrating a state where the lever of the lever-type connector according to the embodiment slides and is attached to the attachment hole of the vehicle body panel.

Taper portions 31*a* are formed on the electric wire cover 40 side of the operation portion 31. As illustrated in FIG. 10, after fitting the male housing 21 and the female housing 51, the fitted male housing 21 and female housing 51 are assembled in the mounting hole 11*a* of the vehicle body panel 11. Then, as illustrated in FIG. 11, the lever 30 is slid to a normal position by the tapered portions 31*a* being pushed by the end surface of the mounting hole 11*a*. Whether the male housing 21 and the female housing 51 can be assembled to the vehicle body panel 11 is detected based on whether the lever 30 can slide.

As illustrated in FIGS. 1, 2, and 4, a bearing hole (bearing portion) 33 having a shaft sliding groove 34 in which the support shaft 24 slides is formed in the center of each of the arm portions 32. A pin-shaped cam follower 35 is integrally formed on each of the arm portions 32. An arc-shaped guide groove 36 with which the guide protrusion 26 engages is formed on each of the arm portions 32 at a portion between the operation portion 31 and the bearing hole 33. Each of the guide groove 36 is formed in an elongated arc shape centered on the support shaft 24. A pickup taper 36*a* for guiding the guide protrusion 26 is formed on the open end side of each of the guide grooves 36.

As illustrated in FIG. 4, each of the arm portions 32 is provided with a sliding portion 37 on which the guide protrusion 26 can slide in the sliding direction after the lever 30 is rotated. The sliding portion 37 is formed in a rail shape whose inside is recessed. Each of the arm portions 32 is provided with an abutting portion 38 with which the guide protrusion 26 abuts at the end of the slide after the lever 30 is rotated. When the male housing 21 and the female housing 51 are fitted together by the rotation operation of the lever 30, the guide projection 26 slides along the sliding portion 37 until the guide projection 26 abuts on the contact portion 38, thereby sliding the lever 30 against the male housing 21.

A locking arm 39 that is elastically deformable in a direction perpendicular to the fitting direction is integrally formed on the outer side of the tip of each of the arm portions 32. The protrusion 39*a* provided on each of the locking arms 39 is configured to be able to be locked to and disengaged from the temporary locking recess 27 and the main locking recess 28 provided on each side surface 22*a* of the male housing 21. That is, the locking arm 39 is also used for locking and unlocking the temporary locking recess 27 and the main locking recess 28 of the male housing 21.

As illustrated in FIG. 2, the female housing 51 is formed in a rectangular block shape and includes terminal accommodating chambers 52 in which the female terminals 59 are accommodated. At the position of each side surface 51*a* of the female housing 51 facing the temporary locking recess 27 of each side surface 22*a* of the male housing 21, a release projection 53 for releasing temporary locking of the projection 39*a* of the locking arm 39 and the temporary locking recess 27 is integrally and protrudingly formed.

An opening 54 is formed on one side surface 51*a* of the female housing 51. A second side retainer 55 for locking the female terminal 59 is fitted into the opening 54.

The frame 60 includes a rectangular tube-shaped frame body 61 having an open top surface and a frame plate-shaped flange portion 62 integrally formed with the frame body 61.

A cam groove 63 with which the cam follower 35 of the lever 30 is engaged is formed on each side wall 61*a* of the frame body 61. An elastically deformable panel locking arm 64 that is locked in the mounting hole 11*a* of the vehicle body panel 11 is integrally formed at a position of each side wall 61*a* of the frame body 61 near the flange portion 62. A peripheral edge of the mounting hole 11*a* of the vehicle body panel 11 is locked between the protrusion 64*a* of the panel locking arm 64 and the flange 62. The groove-shaped water stop portion 66 of the grommet 65 is fitted to the flange portion 62.

As illustrated in FIGS. 2 and 13, an electric wire 29A is connected to each of the male terminals 29, and a wire harness W/H is constituted by a bundle of a plurality of electric wires 29A. An electric wire 59A is connected to each of the female terminals 59, and a bundle of a plurality of electric wires 59A constitutes a wire harness W/H.

Figure 5:
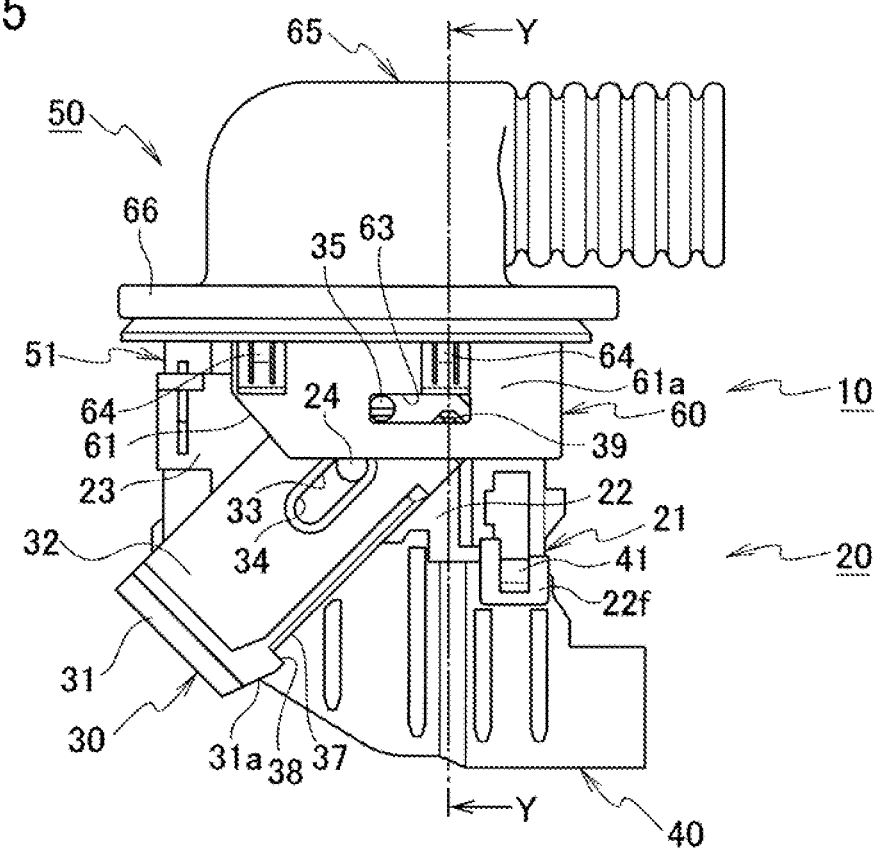
FIG. 5 is a side view illustrating a state in which the lever of the lever-type connector according to the embodiment is temporarily locked.
Figure 6:
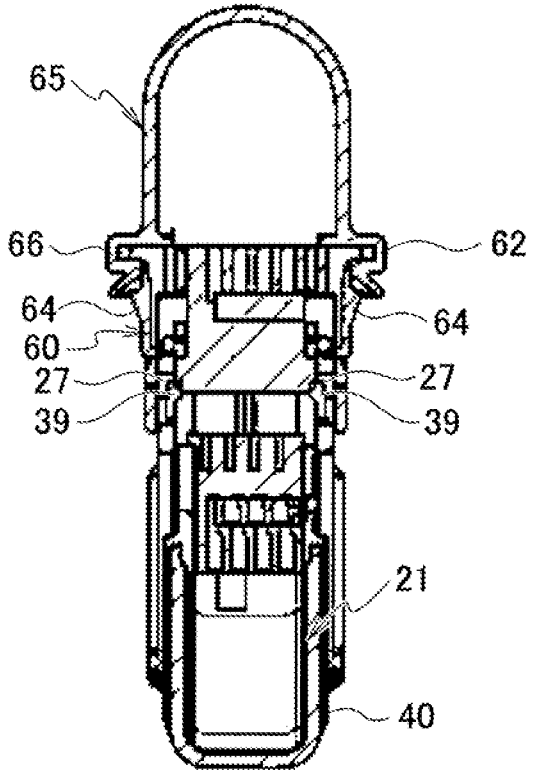
FIG. 6 is a sectional view taken along the line Y-Y of FIG. 5.
Figure 9A:
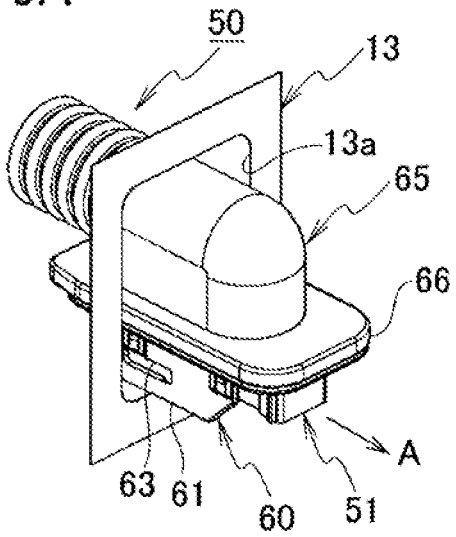
FIGS. 9A to 9E are perspective views illustrating a procedure for attaching the lever-type connector according to the embodiment to a vehicle body panel.
Figure 9B:
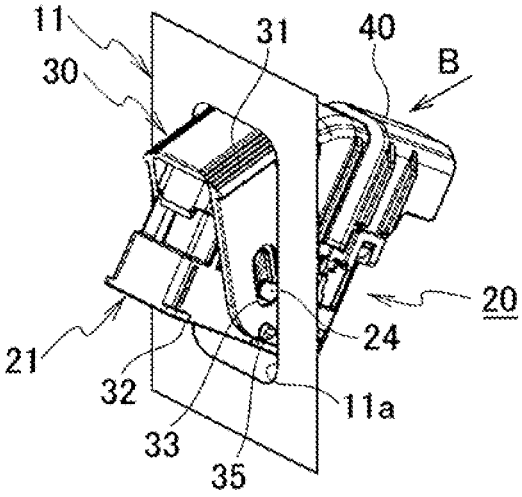

With the lever-type connector 10 according to the embodiment, when the lever-type connector 10 is assembled in the mounting hole 11*a* of the vehicle body panel 11, first, as illustrated by an arrow A in FIG. 9A, the female connector 50 with the grommet 65 attached to the frame 60 is passed through a through hole 13*a* of a door panel 13. Then, as indicated by an arrow B in FIG. 9B, the male connector 20 with the lever 30 in the temporarily locked state is passed through the mounting hole 11*a* of the vehicle body panel 11. When the lever 30 is temporarily locked to the male housing 21, the protrusion 39*a* of the locking arm 39 of the lever 30 is temporarily locked in the temporary locking recess 27 of the male housing 21, as illustrated in FIGS. 5 and 6, thus the lever 30 cannot be rotated in the fitting direction of the male housing 21 and the female housing 51. When the female housing 51 is pushed into the hood portion 23 of the male housing 21 from the temporarily locked state, the release projection 53 of the female housing 51 elastically deforms the locking arm 39 of the lever 30 to the outside, thus the temporary locking state of the temporary locking recess 27 of the housing 21 and the projection 39*a* of the locking arm 39 of the lever 30 is released and the lever 30 can be rotated in the fitting direction of the male housing 21 and the female housing 51.

Figure 9C:
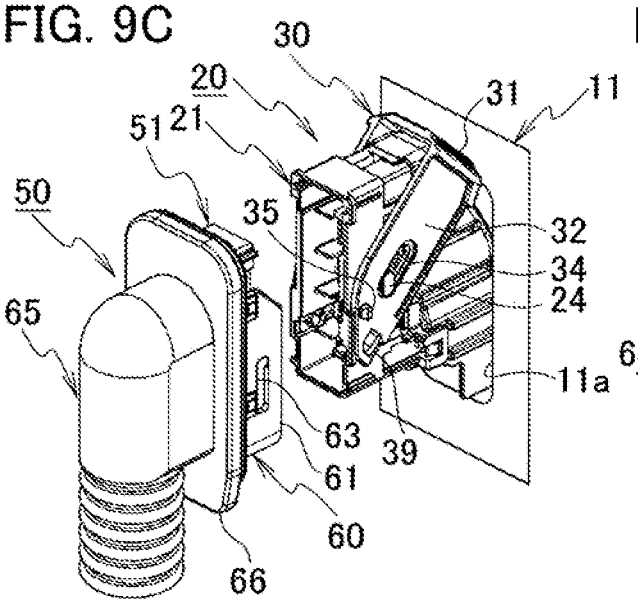

Next, as illustrated in FIG. 9C, the male housing 21 of the male connector 20 and the female housing 51 of the female connector 50 are opposed to each other, and the cam follower 35 of the lever 30 is inserted into and engaged with the cam groove 63 of the frame 60 of the female connector 50.

Figure 9D:
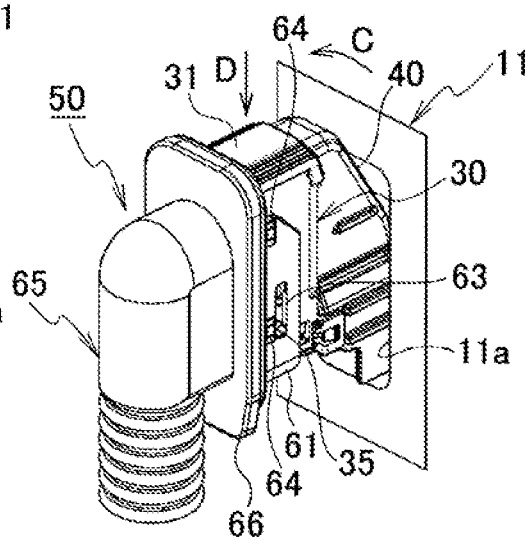

Then, as illustrated by an arrow C in FIG. 9D, the lever 30 is rotated to complete the fitting of the male housing 21 of the male connector 20 and the female housing 51 of the female connector 50.

At this time, with the bearing shaft 33 of the lever 30 slidingly contacting the support shaft 24 of the male housing 21, the arc-shaped guide groove 36 of the lever 30 moves along the guide protrusion 26 of the male housing 21 thereby rotating the lever 30. Then, when the rotation of the lever 30 is completed, the guide protrusion 26 of the male housing 21 is disengaged from the pickup taper 36*a* at the open end of the arc-shaped guide groove 36 of the lever 30, and the lever 30 becomes slidable with respect to the male housing 21.

Figure 7:
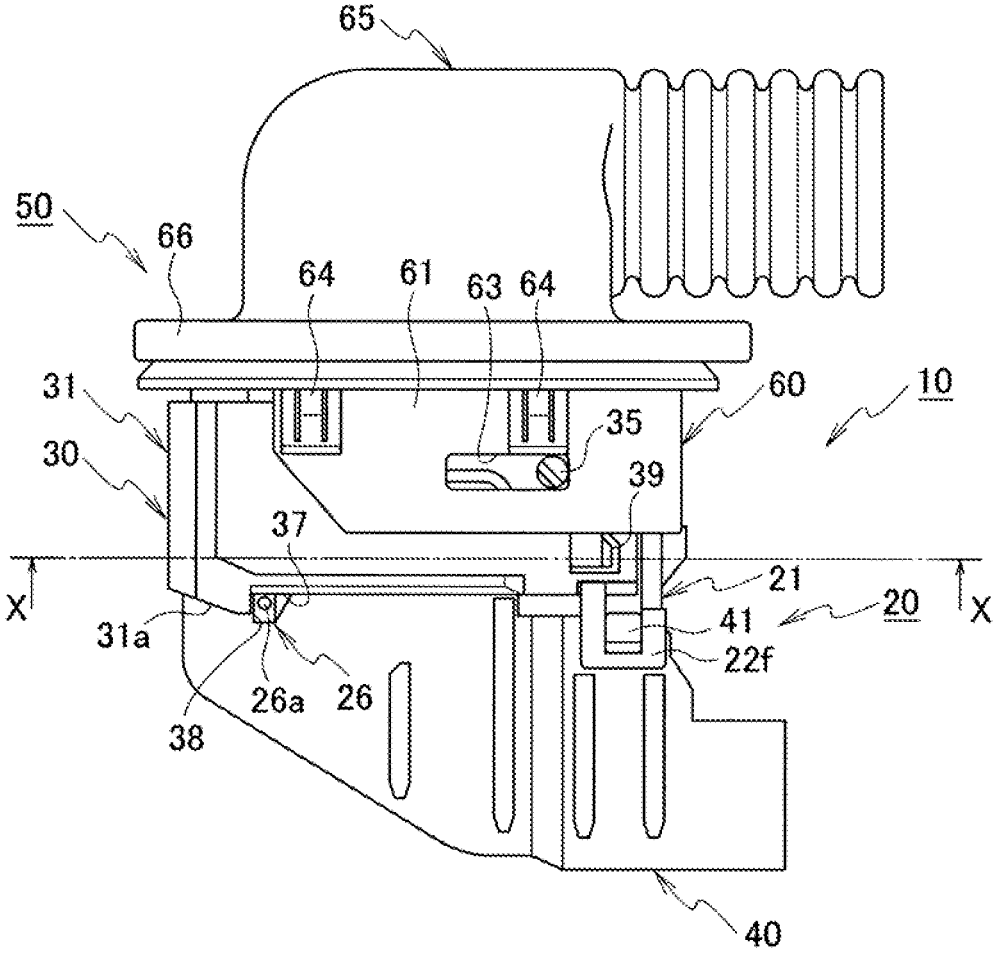
FIG. 7 is a side view illustrating a state where the lever of the lever-type connector according to the embodiment is fully locked.
Figure 8:
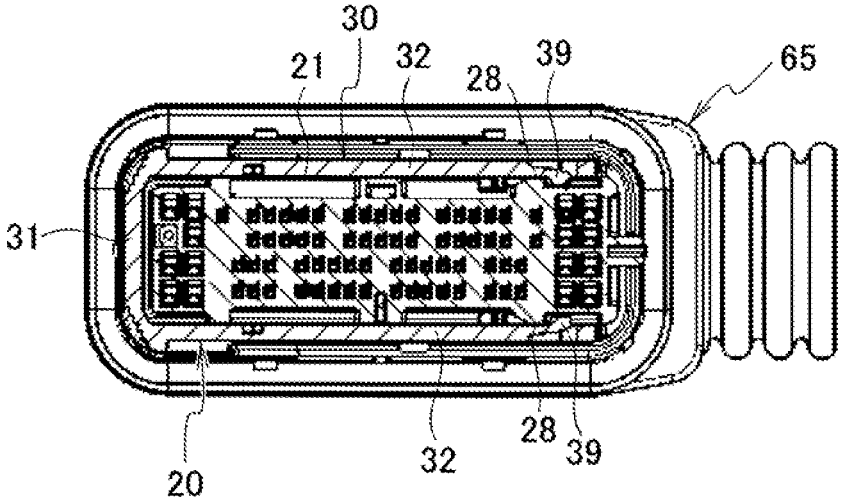
FIG. 8 is a sectional view taken along the line X-X of FIG. 7.

After that, as illustrated by the arrow D in FIG. 9D, the lever 30 is slid along the guide protrusion 26 of the male housing 21 by pushing in the operation portion 31 of the lever 30. Then, as illustrated in FIGS. 7 and 8, the protrusion 39*a* of the locking arm 39 of the lever 30 is locked in the main locking recess 28 of the male housing 21. When the lever 30 is slid, the shaft sliding groove 34 of the lever 30 makes sliding contact with the support shaft 24 of the male housing 21.

Figure 12B:
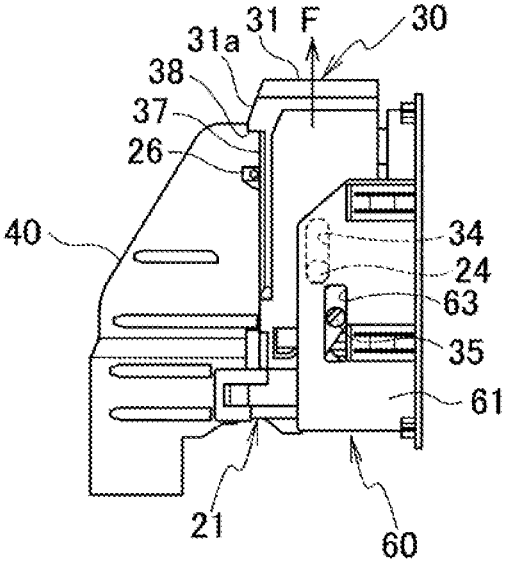
Figure 12C:
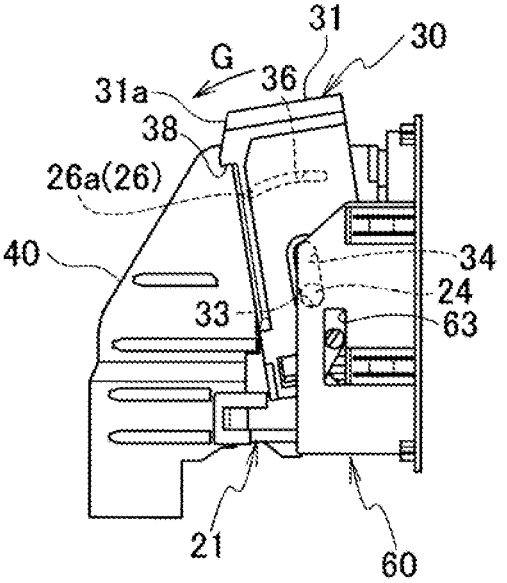

When the lever 30 is slid along the guide protrusion 26 of the male housing 21, as illustrated in FIG. 12B, the guide protrusion 26 of the male housing 21 is near the taper portion 31*a* of the operation portion 31 of the lever 30. Therefore, when the lever 30 is slid in the tilting direction with respect to the shaft sliding groove 34 of the lever 30 and the arc-shaped guide groove 36, a tilt suppressing effect is obtained. As a result, it is possible to reliably prevent damage to the support shaft 24 of the male housing 21 and the lever 30. Further, the guide protrusion 26 is provided in the vicinity of the operation portion 31, and is used (shared) for both rotation and slide of the lever 30. Therefore, it is possible to reduce the size and weight of the entire connector by suppressing the lever ratio. Further, the top portion 26*a* of the guide protrusion 26 is set to be inward of the sliding portion 37 and the contact portion 38 of the lever 30 in the vertical direction, and does not protrude outward from the arm portion 32. Therefore, it is possible to reliably prevent the guide protrusion 26 from being damaged when it is assembled to the vehicle body by the lever 30 described later.

Figure 9E:
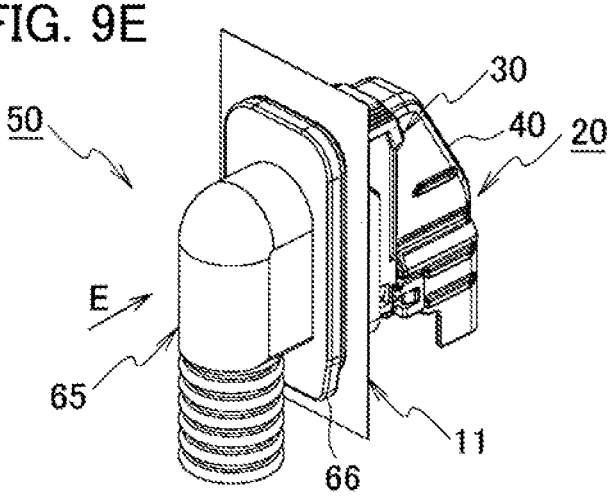

Then, as illustrated by the arrow E in FIG. 9E, the female connector 50, which has been completely operated by the operation portion 31 of the lever 30, is pushed into the mounting hole 11*a* of the vehicle body panel 11. The protrusion 64*a* of the locking arm 64 provided on the frame 60 of the female connector 50 is locked to the peripheral edge of the mounting hole 11*a* of the vehicle body panel 11. Further, by holding the water stop portion 66 of the grommet 65 pressed against the vehicle body panel 11, it is possible to prevent water from entering the lever-type connector 10 through the mounting hole 11*a* of the vehicle body panel 11.

As illustrated in FIGS. 10 and 11, when the male housing 21 and the female housing 51, which have been completely fitted, are pushed into the vehicle body panel 11 and assembled into the mounting hole 11*a*, there is a case where the lever 30 is not slid to the normal position of the male housing 21 (a position where the contact portion 38 of the arm portion 32 of the lever 30 comes into contact) (including a case where the sliding movement amount of the lever 30 is slightly insufficient). In this case, the tapered portion 31*a* of the operation portion 31 of the lever 30 is pushed by the edge surface of the mounting hole 11*a*, and the lever 30 is forcibly slid to the normal position. Therefore, as illustrated in FIGS. 9E and 11, by sliding the lever 30 to the normal position of the male housing 21, only the male housing 21 and the female housing 51, which have been completely fitted, are easily and surely assembled to the vehicle body panel 11. Further, when the lever 30 is not slid to the normal position of the male housing 21, it cannot be assembled to the vehicle body panel 11, so that an abnormality can be detected. As described above, whether or not the lever 30 can be slid, that is, the position of the lever 30 to the vehicle body panel 11 is detected, thereby easily and reliably detecting the mountable state of the lever-type connector 10 to the mounting hole 11*a* of the vehicle body panel 11.

When the male housing 21 and the female housing 51, which are fitted together, are to be removed, as illustrated in FIG. 12A, from the pre-sliding state of the lever 30 before the male housing 21 and the female housing 51 are removed from each other, the lever 30 is moved to a position where it can be slid as illustrated by an arrow F in FIG. 12B. As a result, the guide protrusion 26 of the male housing 21 can be accommodated from the pickup taper 36*a* at the open end of the arc-shaped guide groove 36 of the lever 30. Then, after that, as illustrated by an arrow G in FIG. 12C, the lever 30 can be smoothly rotated with respect to the male housing 21, and the male housing 21 and the female housing 51 can be removed. Even when the male housing 21 and the female housing 51 are detached, the support shaft 24 and guide protrusion 26 of the male housing 21, and the lever 30 are surely prevented from being damaged, same as in the case of the rotation and sliding of the lever 30 at the time of fitting described above.

In this way, when the male housing 21 of the male connector 20 and the female housing 51 of the female connector 50 are fitted and disengaged, the locking arm 39 of the lever 30 is used for engaged with and disengaged from the temporary locking recess 27 and the main locking recess 28 of the male housing 21. Thus, there is no need for dedicated locking arms for temporary locking and main locking on the lever 30. For this reason, it can be prevented that the strength of the lever 30 is reduced and the size of the lever 30 is increased by providing a plurality of locking arms dedicated to the temporary locking and the main locking to the pair of arm portions 32 of the lever 30 as in the conventional example. Therefore, it is possible to reduce the fitting force of the lever-type connector 10 having a larger number of terminals without increasing the size of the entire connector.

According to the above-described embodiment, the male housing 21 is provided with the support shaft 24, and the lever 30 is provided with the bearing portion 33 having the shaft sliding groove 34 in which the support shaft 24 slides. However, the lever 30 may be provided with a support shaft, and the male housing 21 may be provided with a bearing portion having a shaft sliding groove in which the support shaft slides.

Further, according to the above-described embodiment, the cam follower 35 is provided on the lever 30 and the cam groove 63 with which the cam follower 35 is engaged is provided on the frame 60 of the female connector 50. However, a cam follower may be provided on the frame 60 of the female connector 50 or the female housing 51 and the lever 30 may be provided with a cam groove with which the cam follower engages.

Further, according to the above-described embodiment, the male housing 21 is provided with the guide protrusion 26 and the lever 30 is provided with the guide groove 36 with which the guide protrusion 26 engages. However, the lever 30 is provided with a guide protrusion, and the male housing 21 or the wire cover 40 may be provided with a guide groove with which the guide protrusion engages.

Further, according to the above-described embodiment, the female connector 50 is configured by the female housing 51 and the frame 60 having the flange portion 62 attached to the vehicle body panel 11 and the panel locking arm 64, and the cam groove 63 is formed in the frame 60. However, the female connector 50 may be configured by a female housing having a flange portion attached to the vehicle body panel 11 and a panel locking arm, and the cam groove may be formed in the female housing.

What is claimed is:

1. A lever-type connector, comprising:

a first housing;

a second housing configured to be fitted to and removed from the first housing;

a lever rotatably supported by the second housing, the lever configured to be fitted to and removed the first housing and the second housing by a rotation operation;

a support shaft provided on one of the second housing and the lever;

a bearing portion provided on the other of the second housing and the lever, the bearing portion comprising a shaft sliding groove for sliding the support shaft;

a cam follower provided on one of the lever and the first housing;

a cam groove provided on the other of the lever and the first housing, the cam groove to which the cam follower is engageable;

a guide protrusion provided on one of the lever and the second housing, and a guide groove having an arc-shape provided on the other of the lever and the second housing, the guide groove to which the guide protrusion is engageable, wherein:

when the lever is in the rotation operation, the guide protrusion engaged with the guide groove is guided by the arc-shape of the guide groove, when the first housing and the second housing are completely fitted by the rotation operation of the lever, the engagement between the guide protrusion and the guide groove is released and the lever becomes slidable with respect to the second housing, when the fitting of the first housing and the second housing is completed, the fitting of the first housing and second housing to a vehicle body panel is performed, a taper portion is provided on an operation portion of the lever, and when the fitted first housing and second housing are assembled in a mounting hole of the vehicle body panel, the taper portion is pushed by an end surface of the mounting hole, and the lever slides to a normal position with respect to the second housing.

2. A lever-type connector, comprising:

a first housing;

a second housing configured to be fitted to and removed from the first housing;

a lever rotatably supported by the second housing, the lever configured to be fitted to and removed the first housing and the second housing by a rotation operation;

a support shaft provided on one of the second housing and the lever;

a bearing portion provided on the other of the second housing and the lever, the bearing portion comprising a shaft sliding groove for sliding the support shaft;

a cam follower provided on one of the lever and the first housing;

a cam groove provided on the other of the lever and the first housing, the cam groove to which the cam follower is engageable;

a guide protrusion provided on one of the lever and the second housing, and a guide groove having an arc-shape provided on the other of the lever and the second housing, the guide groove to which the guide protrusion is engageable, wherein:

when the lever is in the rotation operation, the guide protrusion engaged with the guide groove is guided by the arc-shape of the guide groove, when the first housing and the second housing are completely fitted by the rotation operation of the lever, the engagement between the guide protrusion and the guide groove is released and the lever becomes slidable with respect to the second housing, when the fitting of the first housing and the second housing is completed, the fitting of the first housing and second housing to a vehicle body panel is performed, and a state in which the first housing and the second housing are assembled to the vehicle body panel is detected based on whether the lever is slidable with respect to the second housing.

3. The lever-type connector of claim 1, wherein a fitting state of the first housing and the first housing is detected based on whether or not the first housing and second housing are assembled to the vehicle body panel.

* * * * *